US011891732B2

(12) United States Patent
Cheng

(10) Patent No.: US 11,891,732 B2
(45) Date of Patent: Feb. 6, 2024

(54) TEXTILE WITH ELASTICITY

(71) Applicant: TAIWAN PAIHO LIMITED, Chang Hwa Hsien (TW)

(72) Inventor: Sen-Mei Cheng, Chang Hwa Hsien (TW)

(73) Assignee: TAIWAN PAIHO LIMITED, Chang Hwa Hsien (TW)

( * ) Notice: Subject to any disclaimer, the term of this patent is extended or adjusted under 35 U.S.C. 154(b) by 158 days.

(21) Appl. No.: 15/317,978

(22) PCT Filed: Mar. 18, 2015

(86) PCT No.: PCT/CN2015/074434
§ 371 (c)(1),
(2) Date: Dec. 12, 2016

(87) PCT Pub. No.: WO2015/188642
PCT Pub. Date: Dec. 17, 2015

(65) Prior Publication Data

US 2017/0121869 A1 May 4, 2017

(30) Foreign Application Priority Data

Jun. 13, 2014 (CN) ..... 201420316795.2
Feb. 3, 2015 (CN) ..... 201520076344.0

(51) Int. Cl.
*D03D 7/00* (2006.01)
*D04B 21/14* (2006.01)
*D04B 39/06* (2006.01)

(52) U.S. Cl.
CPC ..... *D03D 7/00* (2013.01); *D04B 21/14* (2013.01); *D04B 39/06* (2013.01)

(58) Field of Classification Search
CPC ..... D03D 7/00; D04B 21/14; D04B 39/06
See application file for complete search history.

(56) References Cited

U.S. PATENT DOCUMENTS 2,150,133 A 3/1939 Seidel
3,570,482 A * 3/1971 Emoto ..... A61F 13/00021 602/76
3,832,841 A * 9/1974 Cole ..... A45D 8/34 428/12

(Continued)

FOREIGN PATENT DOCUMENTS

CN 2679189 Y 2/2005
CN 101307527 A 11/2008

(Continued)

*Primary Examiner* — Katharine G Kane
(74) *Attorney, Agent, or Firm* — CKC & Partners Co., LLC

(57) ABSTRACT

The invention disclosed a textile with elasticity. The textile with elasticity includes a plurality of elastic weft units and a plurality of elastic warp yarns of a warp yarn layer. These weft units include a plurality of weft yarns. The warp yarn layer penetrates through gaps formed by the weft units. The warp yarns and the weft yarns all have elasticity. The warp yarn has a twines, wherein each of the twines ties the warp yarn for binding these warp yarns located at the gap. Therefore, the textile with elasticity has good stretching ability and air permeability, and provides comfortable wearing feel by means of yarns wrapped on the weft yarns.

21 Claims, 16 Drawing Sheets

(56) References Cited

U.S. PATENT DOCUMENTS 4,003,224 A * 1/1977 Odham ..... D04B 21/18 66/193
4,236,550 A * 12/1980 Braun ..... D03D 15/08 602/76
4,248,064 A * 2/1981 Odham ..... D04B 21/18 66/190
4,328,841 A * 5/1982 Fontana ..... D03D 13/006 139/419
4,470,250 A * 9/1984 Arenz ..... D02G 3/328 57/225
4,660,605 A * 4/1987 Koch ..... B60R 22/12 139/117
4,728,565 A * 3/1988 Fontana ..... A47C 7/282 442/4
4,733,545 A * 3/1988 Weinle ..... D04B 21/18 66/202
4,813,459 A * 3/1989 Breidegam ..... A61N 1/14 139/420 C
4,818,316 A * 4/1989 Weinle ..... D04B 21/18 156/148
5,125,246 A * 6/1992 Shytles ..... D04B 21/04 66/191
5,139,859 A * 8/1992 Karvanen ..... A47G 27/0225 139/387 R
5,249,414 A * 10/1993 Iwata ..... D02G 3/328 257/E29.162
5,265,445 A * 11/1993 Shytles ..... D04B 21/10 602/76
5,280,887 A * 1/1994 Fontana ..... A47C 23/18 267/142
5,448,779 A * 9/1995 Aldridge ..... A41F 3/00 139/420 A
5,522,240 A * 6/1996 Wall ..... D04B 21/18 66/170
5,527,597 A * 6/1996 Stanhope ..... D02G 3/328 139/426 R
5,632,526 A * 5/1997 McLarty, III ..... D03D 15/00 297/284.1
5,642,633 A * 7/1997 Pedall ..... D04B 21/12 66/193
5,694,981 A * 12/1997 Stanhope ..... A62B 17/003 139/383 R
5,749,400 A * 5/1998 Pascual ..... D03D 7/00 139/421
5,758,697 A * 6/1998 Musha ..... D03D 13/004 139/1 R
5,890,380 A 4/1999 Ives et al.
6,079,236 A * 6/2000 Ives ..... D04B 21/18 66/170
6,267,744 B1 * 7/2001 Roberts ..... D03D 15/08 602/44
6,516,637 B1 * 2/2003 Fancher ..... D04B 21/18 66/170
7,490,634 B2 * 2/2009 Resendez ..... D03D 1/00 139/420 A
7,703,405 B2 * 4/2010 Bridgeman ..... D04H 1/52 112/475.17
8,230,886 B2 * 7/2012 Wang ..... A42C 5/02 139/383 R
9,234,304 B2 * 1/2016 Bruner ..... D02G 3/32
2007/0267084 A1 * 11/2007 Pereira ..... D03D 1/00 139/116.1
2008/0152888 A1 * 6/2008 Tutterow ..... D02G 3/32 428/221
2009/0099497 A1 * 4/2009 Jung ..... A61F 13/00038 602/76
2010/0112275 A1 * 5/2010 Hansen ..... A43B 1/04 428/107
2010/0129597 A1 * 5/2010 Hansen ..... B32B 5/26 428/107
2011/0212659 A1 * 9/2011 Yenici ..... D03D 15/04 442/184
2011/0250808 A1 * 10/2011 Preus ..... D03D 1/0005 442/184
2012/0149263 A1 * 6/2012 Cvek ..... D03D 15/08 442/2
2013/0048140 A1 * 2/2013 Yenici ..... D03D 15/04 139/422
2013/0192748 A1 * 8/2013 Imai ..... A41D 27/24 156/229
2013/0251962 A1 * 9/2013 Reid, Jr. ..... A61F 13/00059 428/196
2013/0260628 A1 * 10/2013 Woods, II ..... D03D 15/08 442/184
2015/0034205 A1 * 2/2015 Yenici ..... D03D 1/00 139/421
2015/0038042 A1 * 2/2015 Erkus ..... D03D 13/004 442/203
2015/0173514 A1 * 6/2015 Kikuchi ..... A47C 31/02 297/451.9

FOREIGN PATENT DOCUMENTS

GB 1568701 A 6/1980
KR 100998250 B1 12/2010

* cited by examiner

TEXTILE WITH ELASTICITY

CROSS-REFERENCE TO RELATED APPLICATION

This application is a continuation of International application No. PCT/CN2015/074434, filed Mar. 18, 2015 which claims the benefits of priority of CN application No. 201420316795.2 filed on Jun. 13, 2014 and No. 201520076344.0 filed on Feb. 3, 2015, the content of which are incorporated herein by reference.

BACKGROUND

Technical Field

The present disclosure relates to a textile. More particularly, the present disclosure relates to a textile with elasticity that has superior elastic and ventilation property.

Description of Related Art

Since the textile machine was invented, textile industry has made remarkable progress. In addition to the development of chemical technology that makes the materials used in textile industry more selective, there is a significant aspect that the different textile structures create special effects for products. In these reasons, the main topic of textile products is not how to keep warm but superior elastic, ventilation property and comfort.

Conventional textile products are usually blended with elastic cottons, such as Lycra and Rayon to make products flexible. However, these materials must be designed as multi-slit to absorb moisture and sweat because they are polymer which is not applicable for the above function. The defect makes these materials unsuitable for clothes in sultry weather.

Some textile products could make up the disadvantage, for example, Non-woven fabric possesses better comfort, elastic and ventilation property, but it is not tough as common woven fabric so would be destroyed easily cause in snag or tear. Besides, Non-woven fabric is restricted in washing and maintenance so is unsuitable for products that are precious or in need of durability.

SUMMARY

In view of this, the present disclosure provides a textile with elasticity using elastic fabrics and special weave structure to be elastic, good in ventilation property and comfort and durable in use.

According to an embodiment of the present disclosure, a textile with elasticity includes a basic cloth and a warp yarn layer. The basic cloth includes a plurality of yarns fixed and parallel to each other. The warp yarn layer includes a plurality of elastic warp yarns and a plurality of twines, wherein the elastic warp yarns are parallel to each other and located on the yarns. The elastic warp yarns and the yarns are crisscross. Each of the twines wraps along each of the elastic warp yarns and fixes the elastic warp yarns and the yarns.

In one example, a diameter of each elastic warp yarn can be 0.05 cm to 0.1 cm, and a distance between any two of the elastic warp yarns 310 which are adjacent to each other can be 0.2 cm to 0.5 cm.

According to another embodiment of the present disclosure, a textile with elasticity applied to a shoe includes two elastic cloths, one of the elastic cloths is disposed on a toe part of a vamp of the shoe, and the other elastic cloth is disposed on an ankle part of the vamp of the shoe. Each of the elastic cloths includes a basic cloth and a plurality of elastic warp yarns. Each of the basic cloths includes a plurality of yarns interwoven with each other. The elastic warp yarns are parallel to each other and picoted on the basic cloth.

In one example, each of the yarns can be interwoven with the elastic warp yarns longitudinally or transversely. A diameter of each of the elastic warp yarns can be 0.05 cm to 0.1 cm, and a distance between any two of the elastic warp yarns which are adjacent to each other can be 0.2 cm to 0.5 cm. The textile with elasticity can further include a supported fabric which can be sawed on the elastic cloth for connecting and supporting each of the elastic cloths. The yarns of the elastic cloth can be elastic.

According to still another embodiment of the present disclosure, a textile with elasticity applied to a protective equipment includes two elastic cloths. Each of the elastic cloths includes a basic cloth and a plurality of elastic warp yarns. Each of the basic cloths includes a plurality of yarns interwoven with each other. The elastic warp yarns are parallel to each other and picoted on the basic cloth.

In one example, each of the yarns can be interwoven with the elastic warp yarns longitudinally or transversely. A diameter of each of the elastic warp yarns can be 0.05 cm to 0.1 cm, and a distance between any two of the elastic warp yarns which are adjacent to each other can be 0.2 cm to 0.5 cm. The textile with elasticity can further include a supported fabric which can be sawed on the elastic cloth for connecting and supporting each of the elastic cloths. The yarns of the elastic cloth can be elastic.

Therefore, the textile with elasticity of the present disclosure can improve elasticity of shoes or protective equipments by using the elastic warp yarns. Moreover, the crisscross structure formed of elastic warp yarns and yarns can also improve the ventilation property of the textile with elasticity conspicuously since the ventilation area of the textile with elasticity is increased. The advantage makes wearer comfort when wearing the shoes or protective equipments.

According to yet another embodiment of the present disclosure, a textile with elasticity includes a first weft unit, a second weft unit, a third weft unit, a fourth weft unit and a warp yarn layer. The first weft unit includes a plurality of first elastic weft yarns that are adjacent and parallel to each other. The second weft unit includes a plurality of second elastic weft yarns that are adjacent and parallel to each other. The third weft unit includes a plurality of third elastic weft yarns that are adjacent and parallel to each other. The fourth weft unit includes a plurality of fourth elastic weft yarns that are adjacent and parallel to each other. Each of the first elastic weft yarns, each of the second elastic weft yarns, each of the third elastic weft yarns and each of the four elastic weft yarns are interwoven by a main yarn and at least one covering yarn respectively, wherein the main yarn can be elastic fabric and the covering yarn can be cottony. Each of the main yarns is helically wrapped by the covering yarns so the first elastic weft yarns, the second elastic weft yarns, the third elastic weft yarns and the four elastic weft yarns can have better tactile feelings. The first weft unit and the second weft unit are disposed on the same plane and separated by a distance. Each of the first elastic weft yarns is adjacent to each other and woven to and fro as continuous S-shaped by a fabric, and so is each of the second elastic weft yarns. Moreover, the first weft unit and the second elastic weft unit can be distributed staggeredly. The third weft unit and the fourth weft unit are disposed on the other same plane and separated in parallel with the first weft unit and the second weft unit by a gap. The third weft unit and the fourth weft unit are corresponded to the first weft unit and the second weft unit respectively. The third weft unit and the fourth weft unit are separated by the distance, too. The third elastic weft yarns and the fourth elastic weft yarns are woven to and fro as continuous S-shaped, thus one of the first elastic weft yarns is corresponded to one of the third elastic weft yarns, and one of the second elastic weft yarns is corresponded to one of the fourth elastic weft yarns. It's noted that the third elastic weft yarns and the fourth elastic weft yarns are woven by the same fabric. The warp yarn layer includes a plurality of elastic warp yarns that are longitudinally disposed within the gap. Each of the elastic warp yarns includes a twine tying one of the elastic warp yarns as a center for binding the first weft unit, the second weft unit, the third weft unit and the fourth weft unit to keep the distance. When each of the twine ties the mentioned units, a plurality of slip knots are created to keep the distance, so that the distance won't be disappear during weaving process. The elastic warp yarns can be elastic fabrics.

With the disclosure of the embodiment, the textile with elasticity can have better ventilation property because of the distance between the first weft unit, the second weft unit, the third weft unit and the fourth weft unit creates many and wide ventilation areas. With the weft units and warp yarn layer that are elastic and interwoven with each other, the textile with elasticity could make better flexibility in multi-direction so suitable to apply to sportswear and sports shoes which are demanded for high durability, high flexibility and better performance in heat dissipation. Moreover, the covering yarns cover on the each of the weft units are absorbent, the feature makes the textile with elasticity comfortable for wearers.

According to further another embodiment of the present disclosure, a textile with elasticity includes a first weft unit, a second weft unit, a plurality of elastic warp yarns and a plurality of twines. The first weft unit includes a plurality of first elastic weft yarns that are adjacent and parallel to each other. The second weft unit includes a plurality of second elastic weft yarns that are adjacent and parallel to each other. Each of the first elastic weft yarns and each of the second elastic weft yarns are interwoven by a main yarn and at least one covering yarn respectively, wherein the main yarn can be elastic fabric. The first weft unit and the second weft unit are disposed on the same plane and separated by a distance. Each of the first elastic weft yarns is adjacent to each other and woven to and fro as continuous S-shaped by a fabric respectively, and so is each of the second elastic weft yarns. Moreover, the first weft yarns and the second elastic weft yarns can be distributed staggeredly. The elastic warp yarns are longitudinally disposed on one side of the first elastic weft yarns and the second elastic weft yarns. Each of the twines ties the corresponded elastic warp yarn as a center for binding the first weft unit and the second weft unit to keep the distance. When each of the twine ties the mentioned units, a plurality of slip knots are created to keep the distance, so that the distance won't be disappear during weaving process. The elastic warp yarns can be elastic fabrics. Because the twines ties the weft yarns disposed on the two side of the textile with elasticity at a time, the third weft unit and the fourth weft unit can be removed. That is, the textile with elasticity can just include the first weft unit, the second weft unit and the warp yarn layer, so the cost for material of the textile with elasticity can be reduce.

Furthermore, the textile with elasticity with single layer is more appropriate for weaving on other products.

According to still further another embodiment of the present disclosure, a textile with elasticity includes a first weft unit, a second weft unit, a third weft unit and a warp yarn layer. The first weft unit includes a plurality of first elastic weft yarns that are adjacent and parallel to each other. The second weft unit includes a plurality of second elastic weft yarns that are adjacent and parallel to each other, and the first weft unit and the second weft unit are disposed on the same plane and separated by a distance. The third weft unit includes a plurality of third elastic weft yarns that are adjacent and parallel to each other. Each of the first elastic weft yarns, each of the second elastic weft yarns and each of the third elastic weft yarns are interwoven by a main yarn and at least one covering yarn respectively, wherein the main yarn can be elastic fabric and the covering yarn can be cottony. Each of the main yarns is helically wrapped by the covering yarns so the first elastic weft yarns, the second elastic weft yarns, the third elastic weft yarns and the four elastic weft yarns can have better tactile feelings. The first elastic weft yarns and the second elastic weft yarns are woven to and fro as continuous S-shaped by a fabric respectively. The third elastic weft yarns are woven to and fro as continuous S-shaped. The third weft unit is disposed on the other plane and parallel to the first weft unit and the second weft unit as a gap. The warp yarn layer includes a plurality of elastic warp yarns that are longitudinally disposed within the gap. Each of the elastic warp yarns includes a twine tying one of the elastic warp yarns as a center for binding the first weft unit and the second weft unit to keep the distance. When each of the twine ties the mentioned units, a plurality of slip knots are created to keep the distance, so that the distance won't be disappear during weaving process. The twines tie the third weft unit in the opposite side of the first weft unit and the second weft unit. Each of the twines ties at least one of the third elastic weft yarns within the distance. The elastic warp yarns can be elastic fabrics.

In the mentioned embodiment, the third weft unit can be dislocated with the first weft unit and the second weft unit, namely the third weft unit can be wrapped in the distance between the first weft unit and the second weft unit. By changing a number of the third elastic weft yarns within the distance, the ventilation property or the transparency of the textile with elasticity can be adjusted.

DETAILED DESCRIPTION

Figure 1:
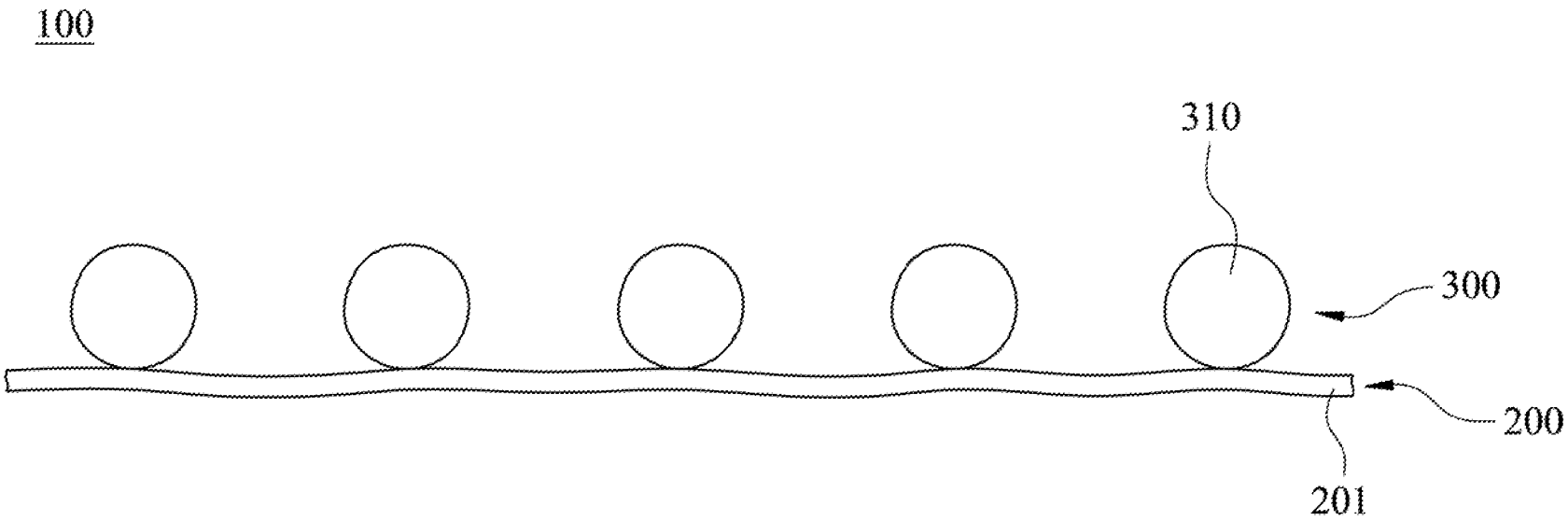
FIG. 1 shows an end schematic view of a textile with elasticity according to one embodiment of the present disclosure.
Figure 2:
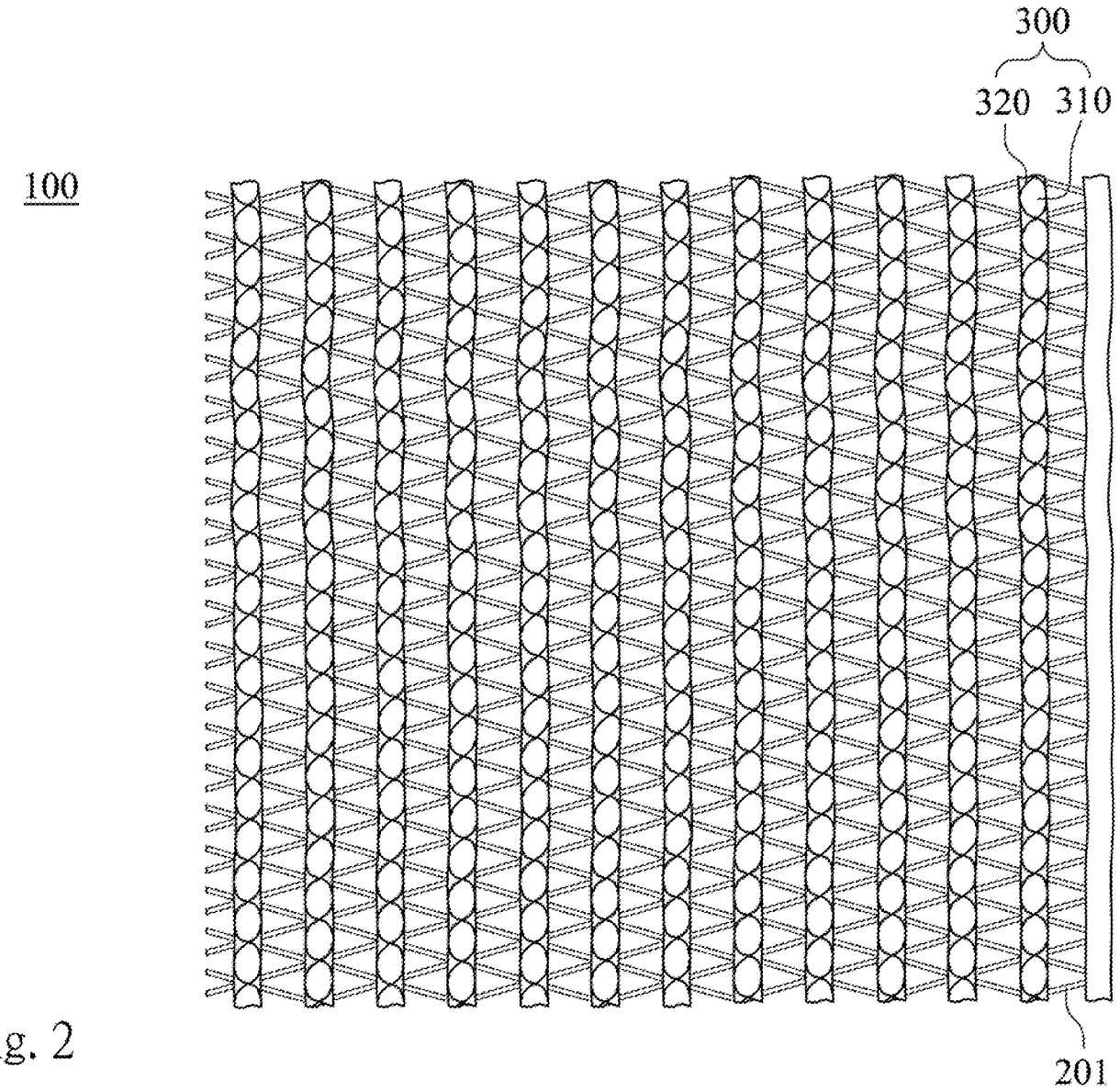
FIG. 2 shows a plane schematic view of the textile with elasticity of FIG. 1.
Figure 3:
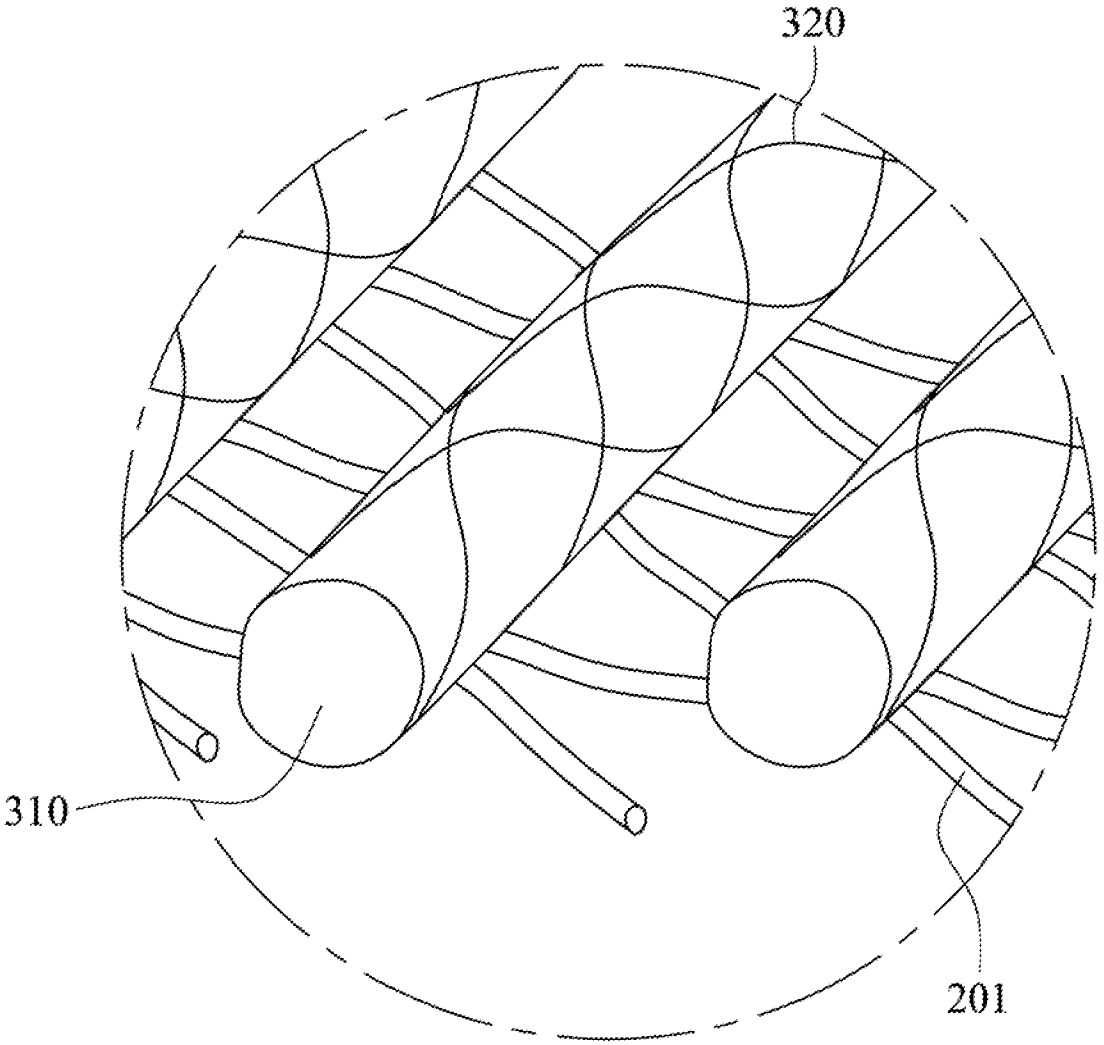
FIG. 3 shows a section of three dimensional view of the textile with elasticity of FIG. 1.

FIG. 1 shows an end schematic view of a textile with elasticity 100 according to one embodiment of the present disclosure. FIG. 2 shows a plane schematic view of the textile with elasticity 100 of FIG. 1. FIG. 3 shows a section of three dimensional view of the textile with elasticity 100 of FIG. 1.

In FIG. 1, FIG. 2 and FIG. 3, the textile with elasticity 100 includes a basic cloth 200 and a warp yarn layer 300.

In said figures, the basic cloth 200 includes a plurality of yarns 201 which can be elastic. The yarns 201 are divided into two groups with different orientations, and the yarns 201 in each group are fixed and parallel to each other. The warp yarn layer 300 includes a plurality of elastic warp yarns 310 and a plurality of twines 320. The elastic warp yarns 310 are parallel to each other and located on the basic cloth 200, and each of the elastic warp yarns 310 and each of the yarns 201 of the basic cloth 200 are crisscross. Each of the twines 320 of the warp yarn layer 300 wraps along each of the elastic warp yarns 310 and fixes one of the elastic warp yarns 310 and the yarns 201 of the basic cloth 200.

To enhance the flexibility of the textile with elasticity 100, the material for the twines 320 can be made of elastic material as the yarns 201. To make the textile with elasticity 100 aesthetic and tough, a diameter of each elastic warp yarn 310 can be 0.05 cm to 0.1 cm, and a distance between any two of the elastic warp yarns 310 which are adjacent to each other can be 0.2 cm to 0.5 cm.

Figure 4A:
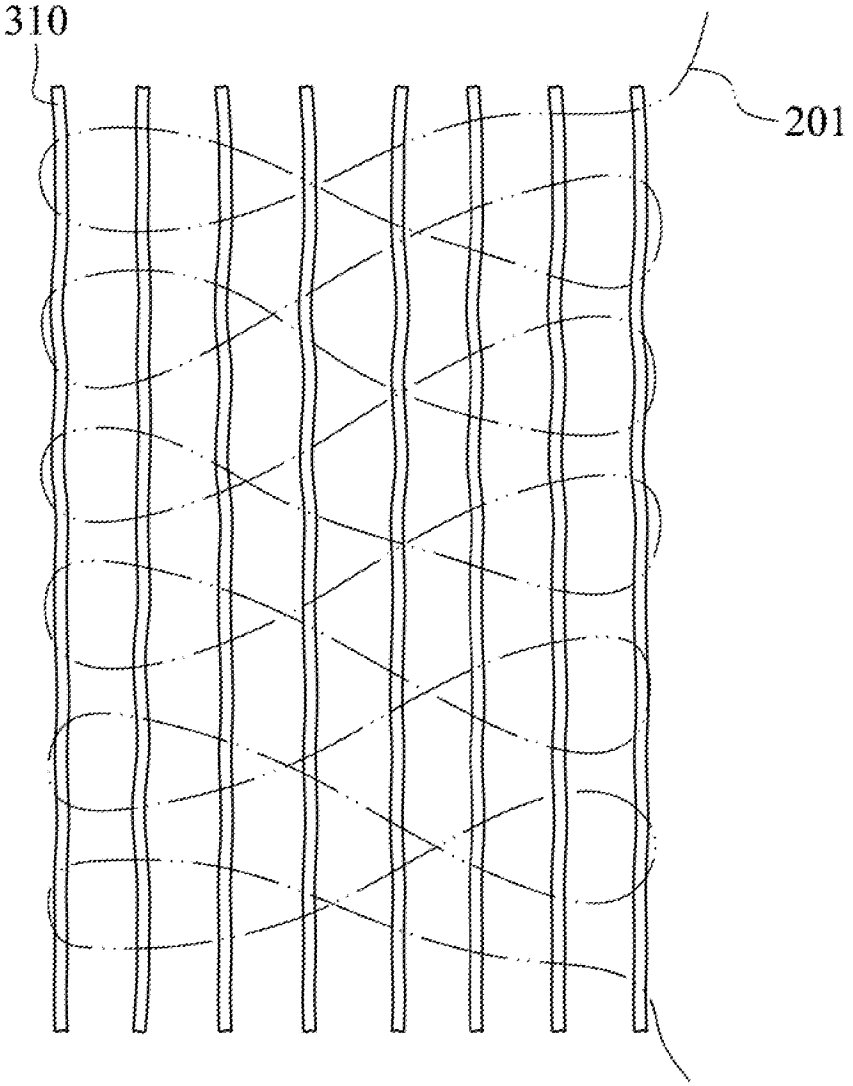
FIG. 4A shows a weaving schematic view of the textile with elasticity of FIG. 1.
Figure 4B:
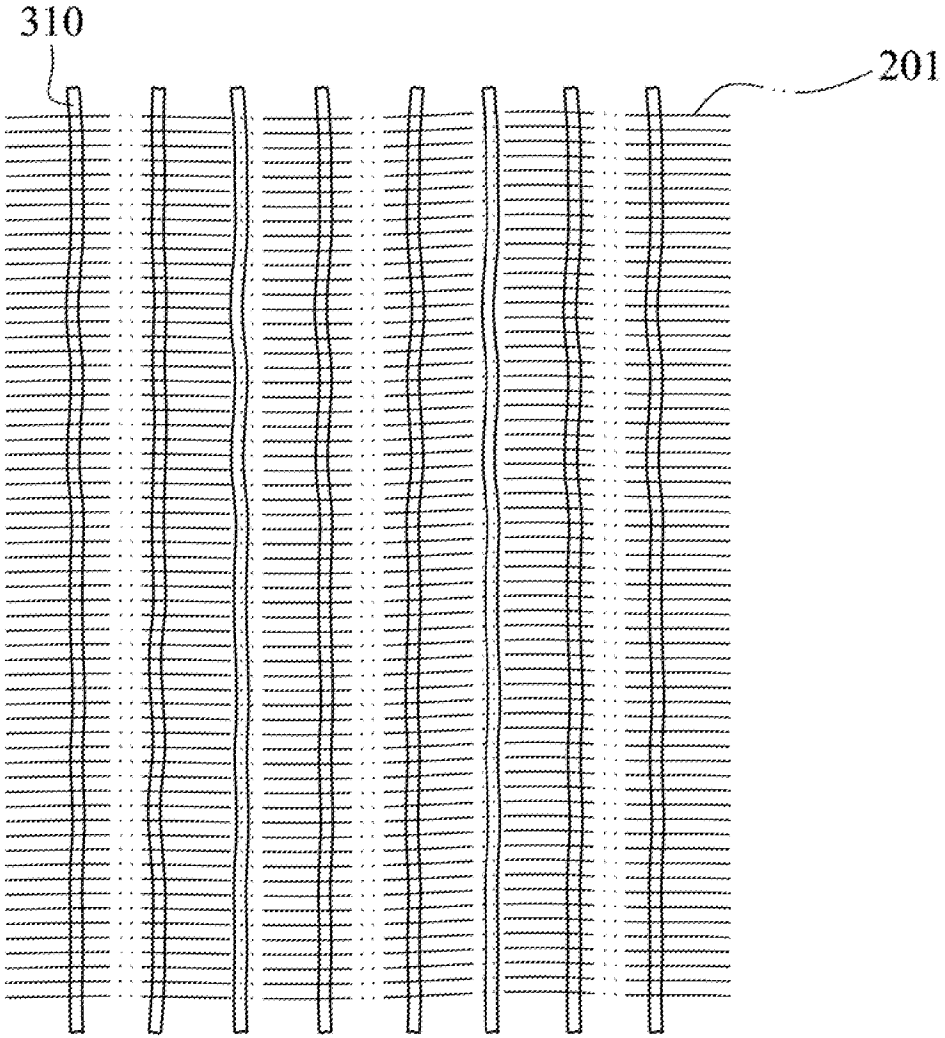
FIG. 4B shows a weaving schematic view of the textile with elasticity of FIG. 1.

FIG. 4A and FIG. 4B show two weaving schematic views of the textile with elasticity 100 of FIG. 1. In FIG. 4A, each of yarns 201 can be weaved as 8-shaped, but the weaving distance would not be restricted herein. In FIG. 4B, the distributions of the yarns 201 and the elastic warp yarns 310 are shown, but the weaving way would not be restricted herein. The yarns 201 can distributed more densely than the elastic warp yarn 310, so that the elastic warp yarn 310 can protrude from the textile with elasticity 100 to make better looks.

Figure 5A:
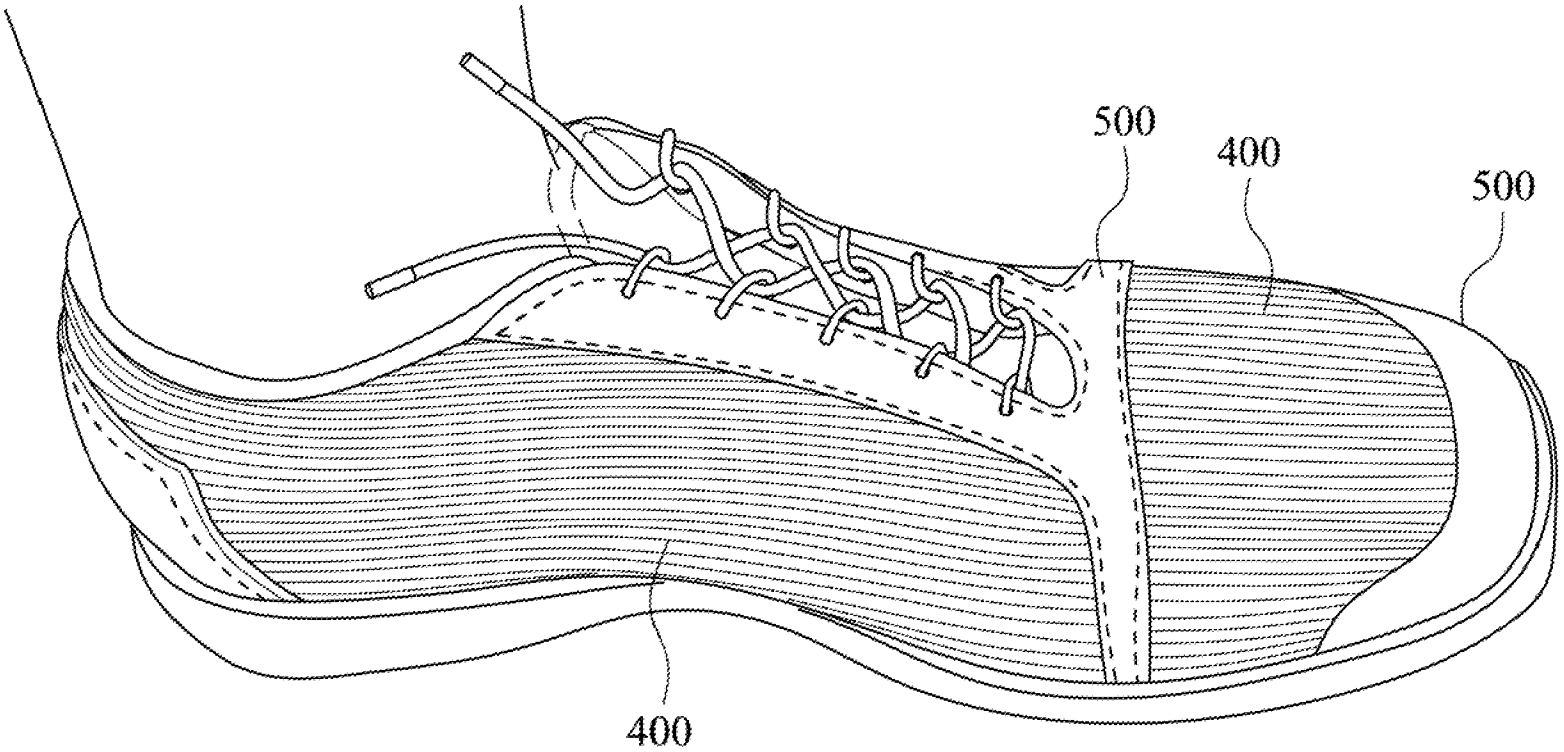
FIG. 5A shows an application schematic view of a textile with elasticity according to another embodiment of the present disclosure.

FIG. 5A shows an application schematic view of a textile with elasticity 100 according to another embodiment of the present disclosure. In FIG. 5A, a textile with elasticity 100 is applied to a vamp of a shoe, the textile with elasticity 100 includes two elastic cloths 400, and each of the elastic cloths 400 includes a basic cloth 200 and a plurality of elastic warp yarns 310. The two elastic cloths 400 are disposed on a toe part and an ankle part of the vamp of the shoe corresponding to the toe and the ankle of the foot of human body, respectively.

Each of the basic cloths 200 includes a plurality of yarns 201 interwoven with each other. The elastic warp yarns 310 are parallel to each other and picoted on the basic cloth 200. The mentioned "picoted" means the elastic warp yarns 310 are disposed on a surface of the basic cloth 200. In FIG. 4A and FIG. 4B, the elastic warp yarns 310 can be fixed and protrude from the basic cloths 200. (To show the weave structures of the elastic warp yarns 310 and the basic cloth 200 dearly, the basic cloths 200 at the under layers are hidden in FIG. 4A and FIG. 4B.) The weave structures in FIG. 4A and FIG. 4B are for example, so the embodiment about "picoted" can be other possible weave structures and not restricted herein.

The textile with elasticity 100 can further include two supported fabric 500 which can be sawed on the elastic cloths 400 for connecting and supporting each of the elastic cloths 400. Each of the supported fabrics 500 can be disposed on areas of toe, heel or shoelace of the vamp of the shoe corresponding to human body.

Each of the yarns 201 can be elastic and can be interwoven with the elastic warp yarns 310 longitudinally or transversely. Moreover, a diameter of each of the elastic warp yarns 310 can be 0.05 cm to 0.1 cm, and a distance between any two of the elastic warp yarns 310 which are adjacent to each other can be 0.2 cm to 0.5 cm.

Figure 5B:
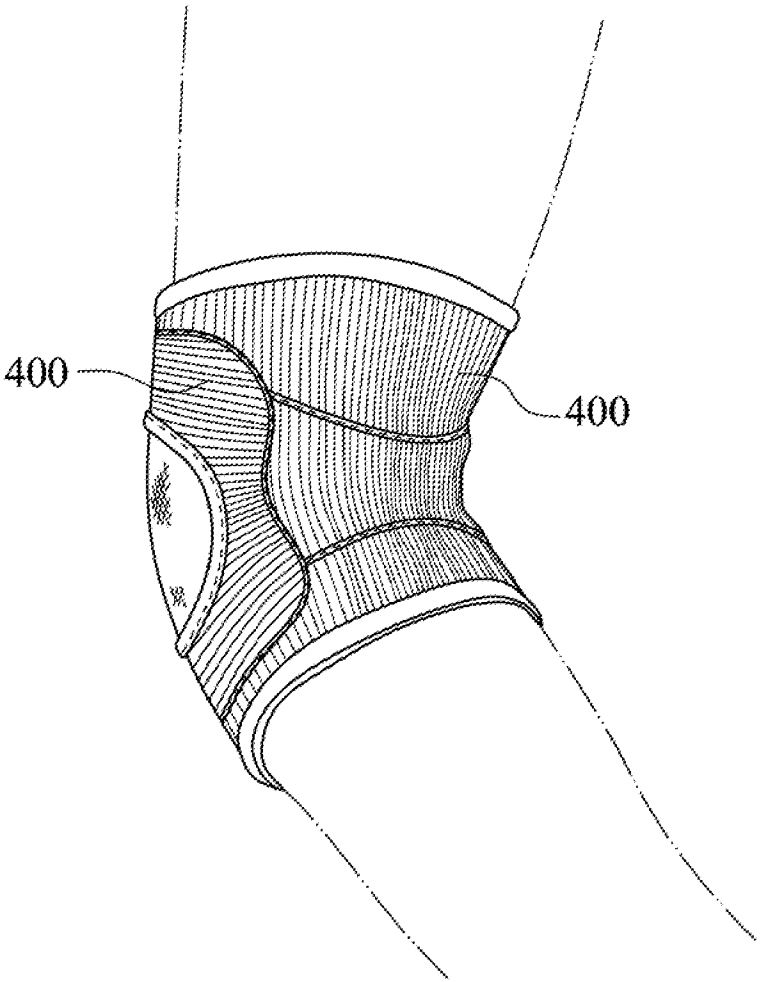
FIG. 5B shows an application schematic view of a textile with elasticity according to still another embodiment of the present disclosure.

FIG. 5B shows an application schematic view of a textile with elasticity 100 according to still another embodiment of the present disclosure. In FIG. 5B, a textile with elasticity 100 is applied to a protective equipment for increasing elasticity and beautifying the looks for weaving products.

The textile with elasticity 100 includes two elastic cloths 400, and each of the elastic cloths 400 further includes a basic cloth 200 and a plurality of elastic warp yarns 310. Each of the basic cloths 200 includes a plurality of yarns 201 interwoven with each other. The elastic warp yarns 310 are parallel to each other and picoted on the basic cloth 200. The definition of "picoted" is the same as the aforementioned statement, and will not be stated again herein.

The textile with elasticity 100 can further include a supported fabric 500 which can be sawed on the elastic cloth 400 for connecting and supporting each of the elastic cloths 400.

Each of the yarns 201 can be elastic and can be interwoven with the elastic warp yarns 310 longitudinally or transversely. Moreover, a diameter of each of the elastic warp yarns 310 can be 0.05 cm to 0.1 cm, and a distance between any two of the elastic warp yarns 310 which are adjacent to each other can be 0.2 cm to 0.5 cm.

Figure 6:
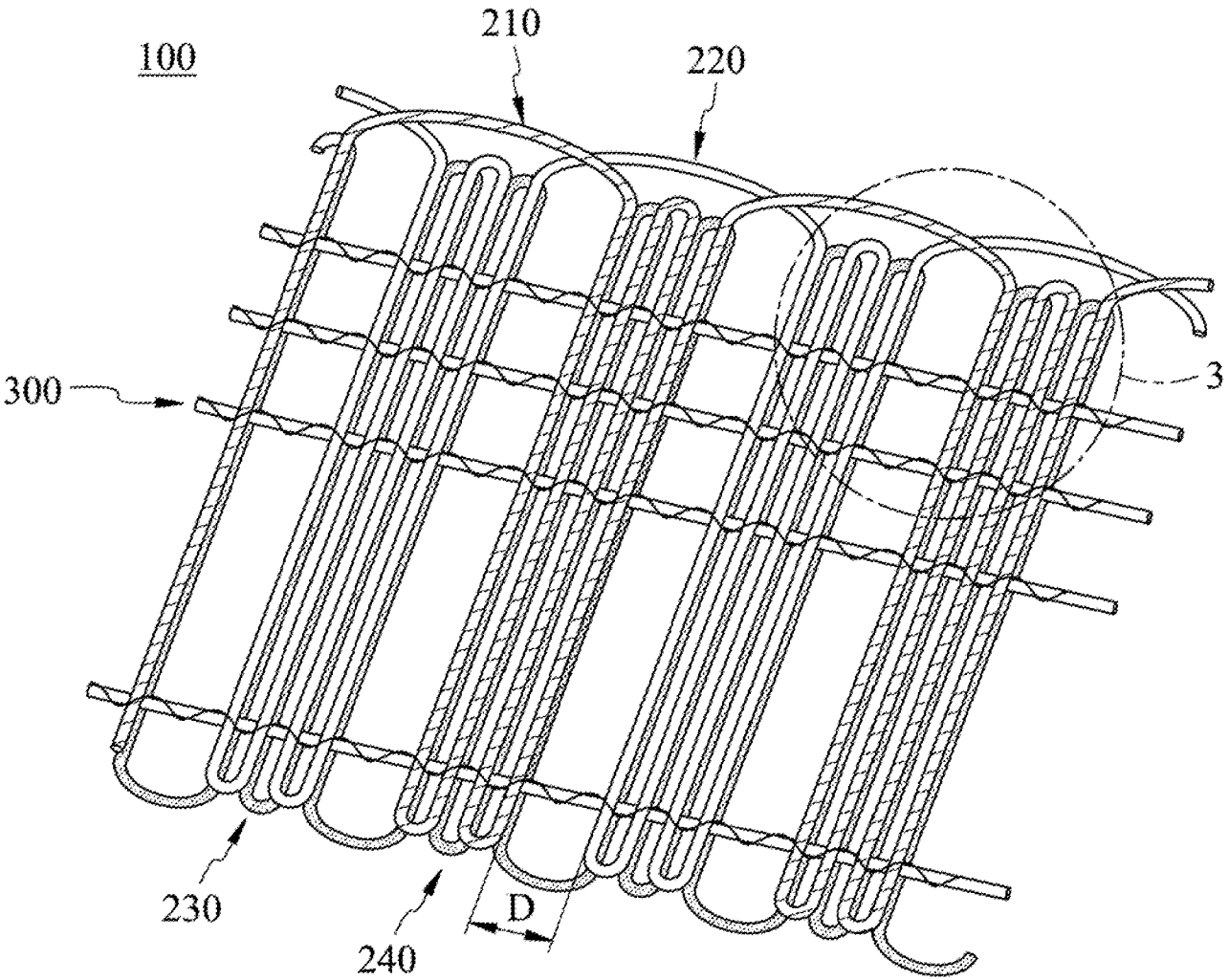
FIG. 6 shows a three dimensional view of a textile with elasticity according to yet another embodiment of the present disclosure.

FIG. 6 shows a three dimensional view of a textile with elasticity 100 according to yet another embodiment of the present disclosure. In FIG. 6, a textile with elasticity 100 includes a first weft unit 210, a second weft unit 220, a third weft unit 230, a fourth weft unit 240 and a warp yarn layer 300.

The first weft unit 210 and the second weft unit 220 are separated by a distance D, and the third weft unit 230 and the fourth weft unit 240 are separated by the distance D, too. Moreover, the first weft unit 210 and the second weft unit 220 are at the front side of the textile with elasticity 100, and the third weft unit 230 and the fourth weft unit 240 are at the rear side of the textile with elasticity 100. The warp yarn layer 300 is disposed between the front side and the rear side of the textile with elasticity 100.

Figure 7:
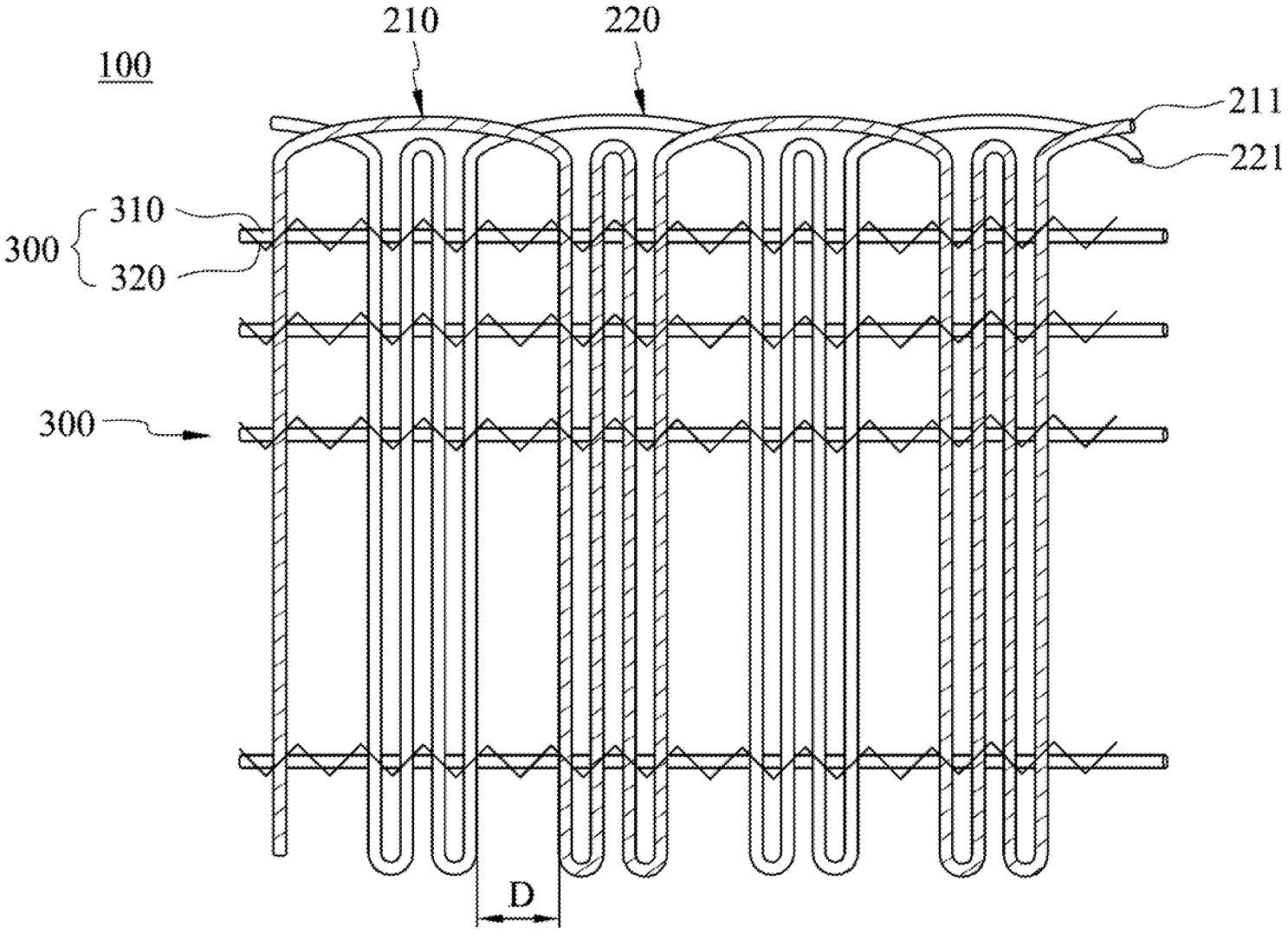
FIG. 7 shows a front side view of the textile with elasticity of FIG. 6.

FIG. 7 shows a front side view of the textile with elasticity 100 of FIG. 6. In FIG. 7, the first weft unit 210 includes a plurality of first elastic weft yarns 211, and the second weft unit 220 includes a plurality of second elastic weft yarns 221. As shown in FIG. 7, the first weft unit 210 including the first elastic weft yarns 211 and the second weft unit 220 including the second elastic weft yarns 221 are distributed staggeredly at the front side of the textile with elasticity 100.

Please see the top of FIG. 7, first elastic weft yarns 211 and the second elastic weft yarns 221 are woven to and fro as continuous S-shaped by a fabric respectively. For example shown in FIG. 7, four of the first elastic weft yarns 211 and four of the second elastic weft yarns 221 are formed into a sub unit respectively, but the present disclosure will not be limited to the number of the first elastic weft yarns 211 or the second elastic weft yarns 221 herein. The first elastic weft yarn 211 and the second elastic weft yarn 221 adjacent to each other are separated by the distance D.

It's noted that not only the first elastic weft yarns 211 or the second elastic weft yarns 221 included in each sub unit can be connected up by single fabric, but each sub unit belong to the first weft unit 210 or the second weft unit 220 can be connected up by the same fabric.

The warp yarn layer 300 is disposed behind the first weft unit 210 and second weft unit 220. The warp yarn layer 300 includes a plurality of elastic warp yarns 310 and a plurality of twines 320. The elastic warp yarns 310 are crossed but not woven with the first elastic weft yarns 211 and the second elastic weft yarns 221. Each of the elastic warp yarns 310 can be elastic fabric. Each of the elastic warp yarns 310 corresponds to a twine 320 tying one of the elastic warp yarns 310 as a center for binding the first weft unit 210, the second weft unit 220, the third weft unit 230 and the fourth weft unit 240, so that the elastic warp yarn 310 can be fixed by the first elastic weft yarns 211, the second elastic weft yarns 221, the third elastic weft yarns 231 and the fourth elastic weft yarns 241.

Figure 8:
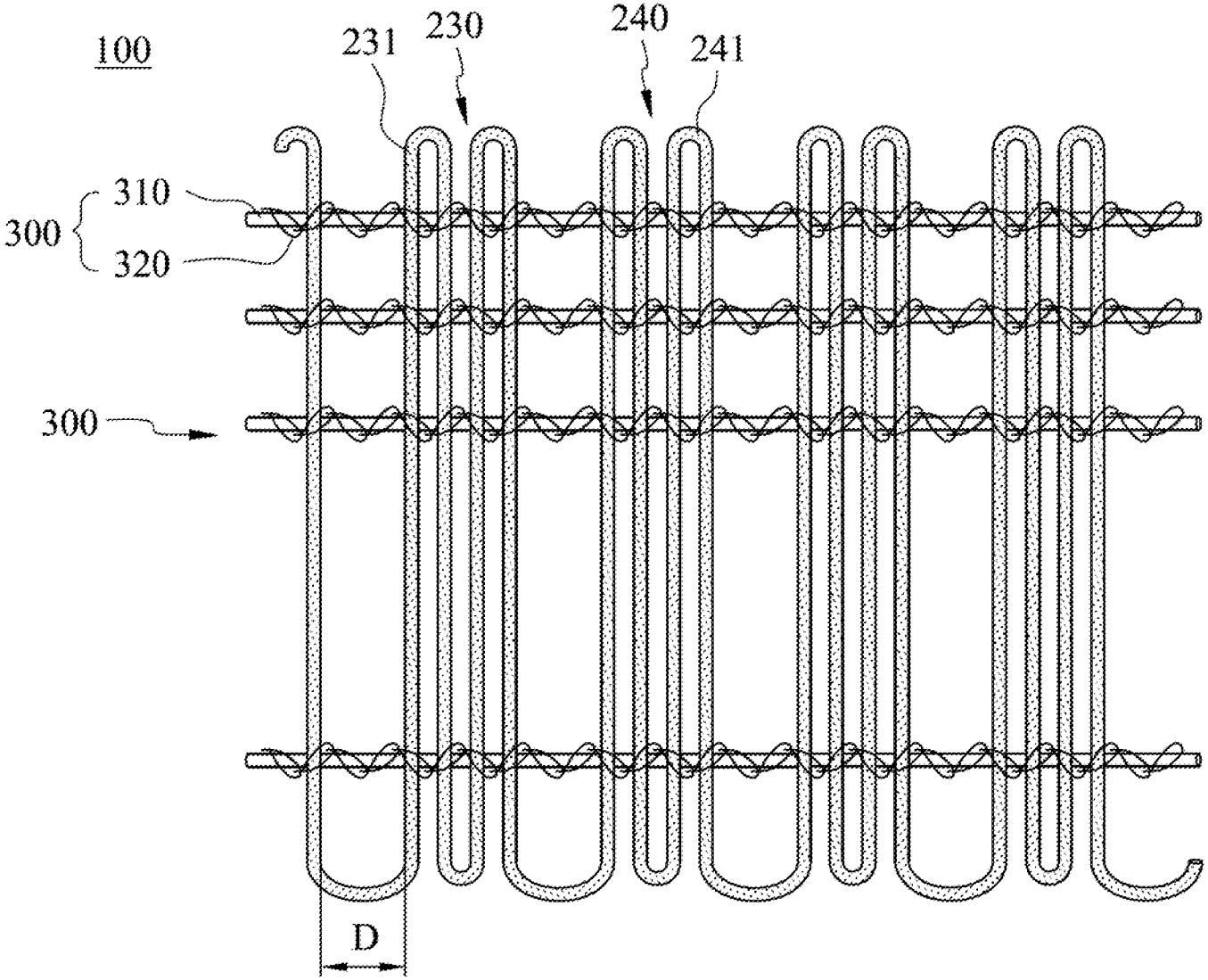
FIG. 8 shows a rear side view of the textile with elasticity of FIG. 6.

FIG. 8 shows a rear side view of the textile with elasticity 100 of FIG. 6. As shown in FIG. 8, the third weft unit 230 and the fourth weft unit 240 are at the rear side and corresponded to the first weft unit 210 and the second weft unit 220 respectively, and the third weft unit 230 and the fourth weft unit 240 are separated by the distance D, too. The difference between the front side and rear side of the textile with elasticity 100 is that the third elastic weft yarns 231 and the fourth elastic weft yarns 241 are woven continuously into continuous S-shaped by single fabric, the fabric connects up the third weft unit 230 and the fourth weft unit 240 at one edge of the textile with elasticity 100.

The third weft unit 230 and the fourth weft unit 240 also can be woven as same as the front side of the textile with elasticity 100. That is, the third weft unit 230 and the fourth weft unit 240 can be connected up at another edge of the textile with elasticity 100. Therefore, the embodiment shown in FIG. 6, FIG. 7 and FIG. 8 would not be a limitation of the present disclosure.

Figure 9:
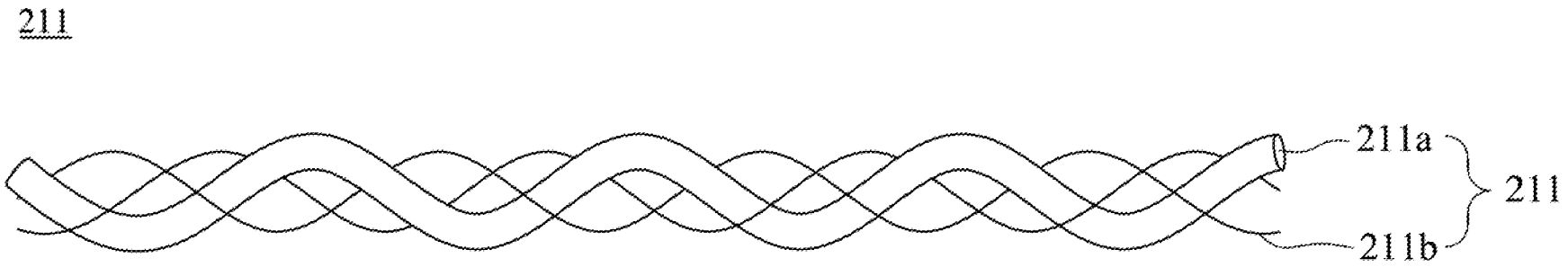
FIG. 9 shows a construction schematic view of the first elastic weft yarn of the textile with elasticity of FIG. 6.

FIG. 9 shows a construction schematic view of the first elastic weft yarn 211 of the textile with elasticity 100 of FIG. 6. According to the embodiment of FIG. 9, each elastic weft yarn is made of two kinds of yarn materials. As shown in FIG. 9, each of the first elastic weft yarns 211 includes a main yarn 211*a* and two covering yarn 211*b*. The main yarn 211*a* can be elastic fabric and helically wrapped by the covering yarns 211*b*.

The material or number of the covering yarns 211*b* can be adjusted as long as features of the textile with elasticity 100 won't be affected, such as cotton yarn etc. which is conventional material. Moreover, the second elastic weft yarn 221, the third elastic weft yarn 231 and the fourth elastic weft yarn 241 are as same material as the first elastic weft yarn 211, and will not further stated herein.

Figure 10:
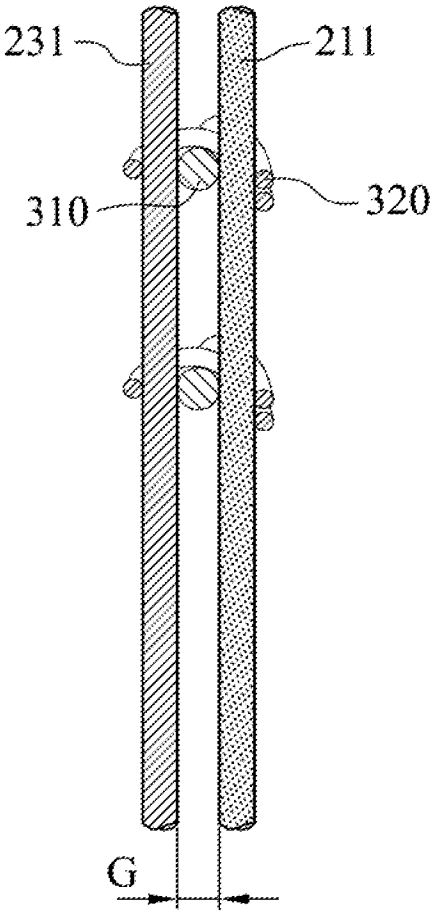
FIG. 10 shows a side view of the textile with elasticity of FIG. 6.

FIG. 10 shows a side view of the textile with elasticity 100 of FIG. 6. As shown in FIG. 10, the first elastic weft yarn 211 and third elastic weft yarn 231 are disposed at two sides of the textile with elasticity 100 and separated by a gap G. Each of the elastic warp yarns 310 is longitudinally disposed within the gap G, and the twines 320 tie the elastic warp yarns 310 as a center for binding the first weft unit 210, the second weft unit 220, the third weft unit 230 and the fourth weft unit 240 then fix the elastic warp yarns 310 with the mentioned weft units.

In detail, the twine 320 ties the first elastic weft yarn 211 and third elastic weft yarn 231 or the second elastic weft yarn 221 and fourth elastic weft yarn 241 together, so that each of the elastic warp yarns 310 can be drawn out longitudinally without affecting the stability of the textile with elasticity 100.

The main differences between the yet another embodiment in FIG. 6 and the first three embodiments in FIG. 1 to FIG. 5B are that the density of the twines 320 in each of the first three embodiments is steady, so that the basic cloth 200 and a warp yarn layer 300 can be woven by the consistent density; however, the density of the twines 320 is further adjusted in the yet another embodiment, thus the function of the textile with elasticity 100 would be varied.

Figure 11A:
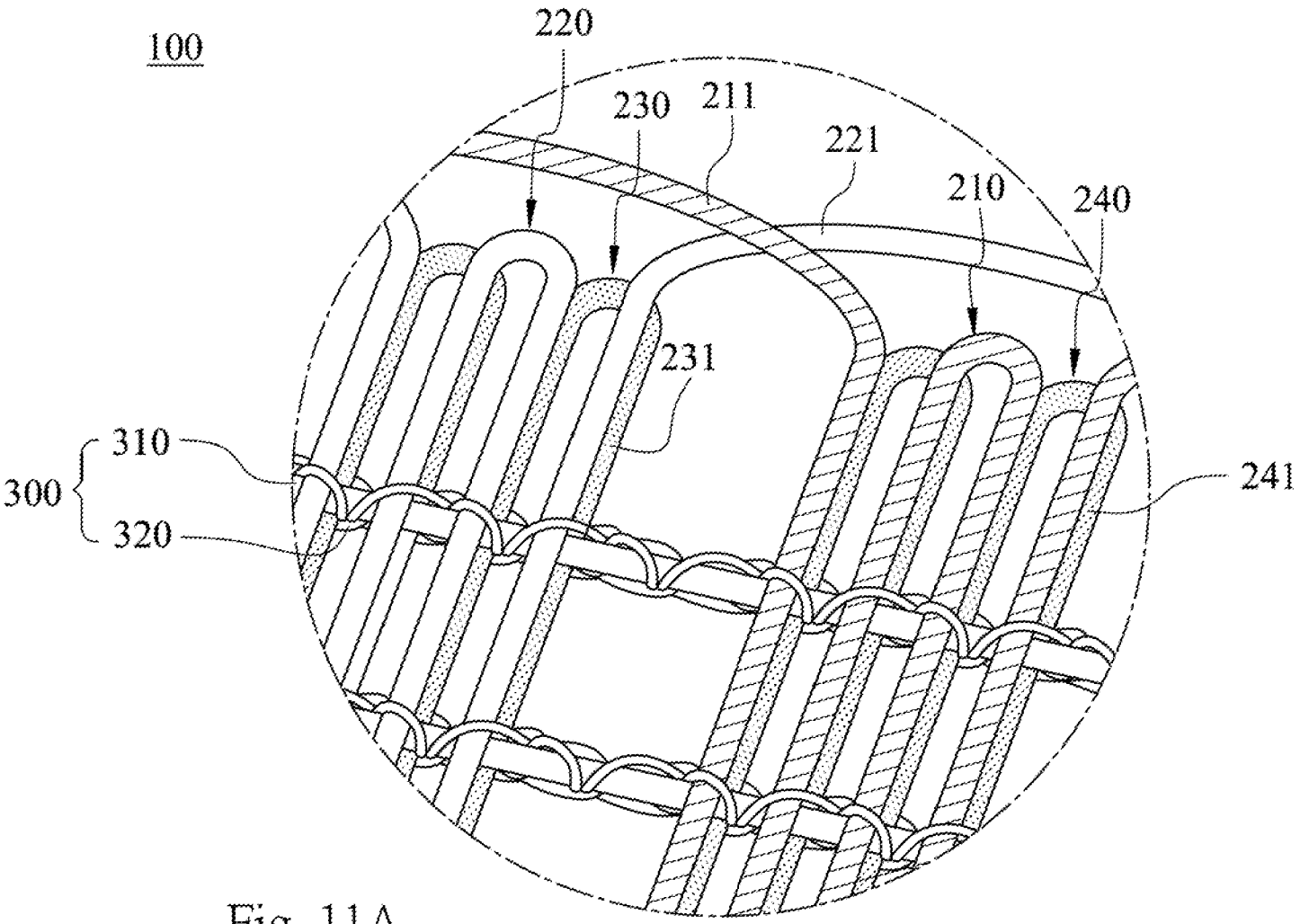
FIG. 11A shows a front side view of an enlarged portion 3 of the elastic warp yarn of the textile with elasticity of FIG. 6.
Figure 11B:
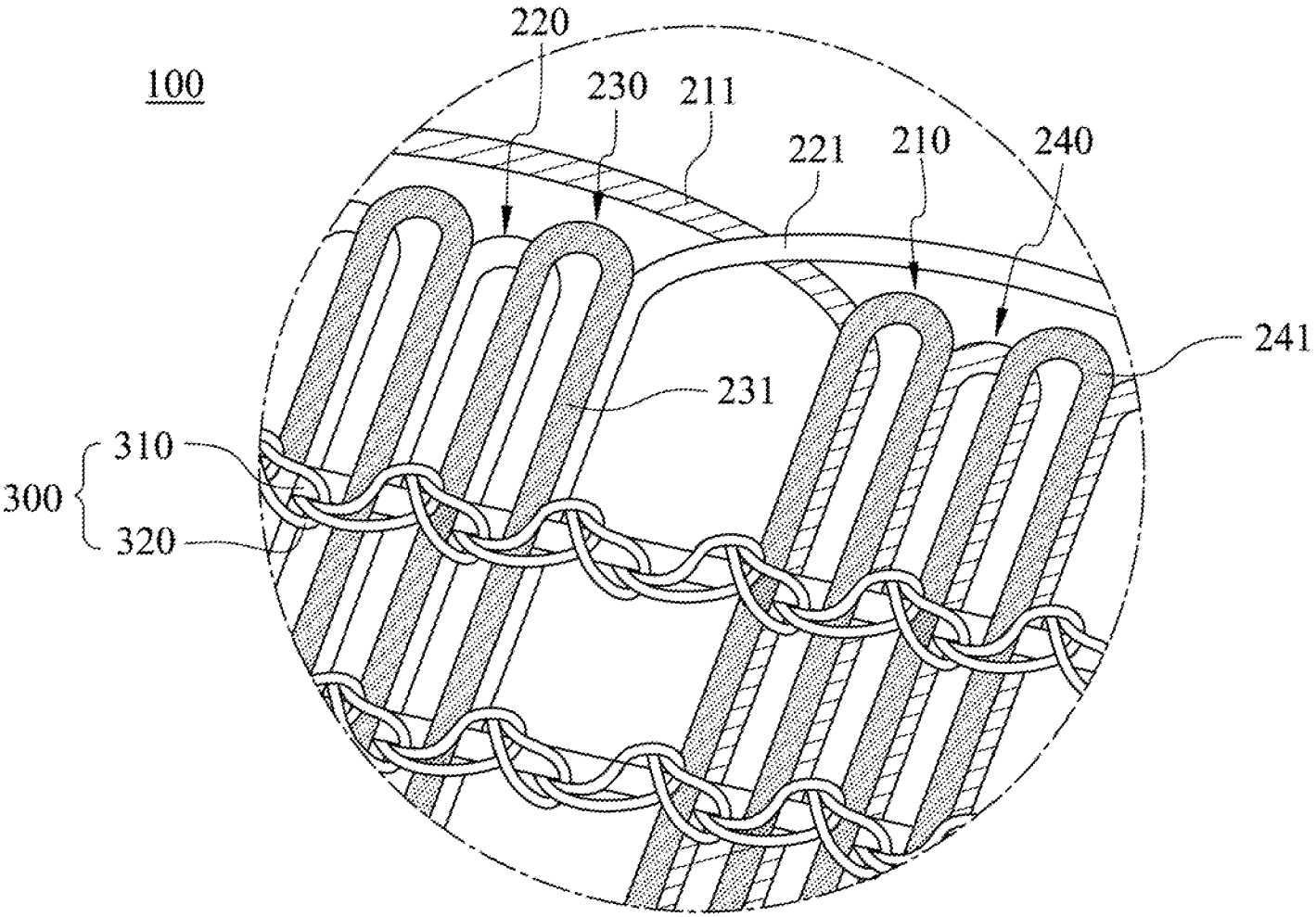
FIG. 11B shows a rear side view of the enlarged portion 3 of the elastic warp yarn of the textile with elasticity of FIG. 6.

FIG. 11A shows a front side view of an enlarged portion 3 of the elastic warp yarn 310 of the textile with elasticity 100 of FIG. 6. FIG. 11B shows a rear side view of the enlarged portion 3 of the elastic warp yarn 310 of the textile with elasticity 100 of FIG. 6. Please refer to FIG. 11A and FIG. 11B, as mentioned in FIG. 10, the twine 320 ties two elastic weft yarns that are disposed at two sides of the textile with elasticity 100 at once.

In FIG. 11A, each of the twines 320 shuttles backwards and forwards through the first elastic weft yarns 211 of the first weft unit 210 (and through the second elastic weft yarns 221 of the second weft unit 220) repeatedly, but all of the elastic weft yarns are never tied at the distance D of the textile with elasticity 100. In FIG. 11B, the twine 320 twirls to form a slip knot at the rear side of the textile with elasticity 100 for receiving the next entrance from the front side of the textile with elasticity 100 by itself.

Since the twine 320 at the distance D never weave with nor towed by any elastic weft yarn, the length of the distance D can be kept or adjusted by changing a number of the slip knots.

According to the yet another embodiment shown in FIG. 6 to FIG. 11B, because the twine 320 fixes the elastic warp yarn 310 within the gap G by tying two elastic weft yarns that dispose at the front side and the rear side of the textile with elasticity 100, the weft units at one side of the textile with elasticity 100 can be fully removed. For example, the third weft unit 230 and the fourth weft unit 240 can be removed, and the first weft unit 210, the second weft unit 220 and the warp yarn layer 300 are remained. In this state, the distance D can still be kept by slip knots because the elastic warp yarns 310 tied by the twine 320 are not drawn out. The embodiment is suitable for products which are needed in higher ventilation property and elasticity but contacting with skin of human body.

Figure 12:
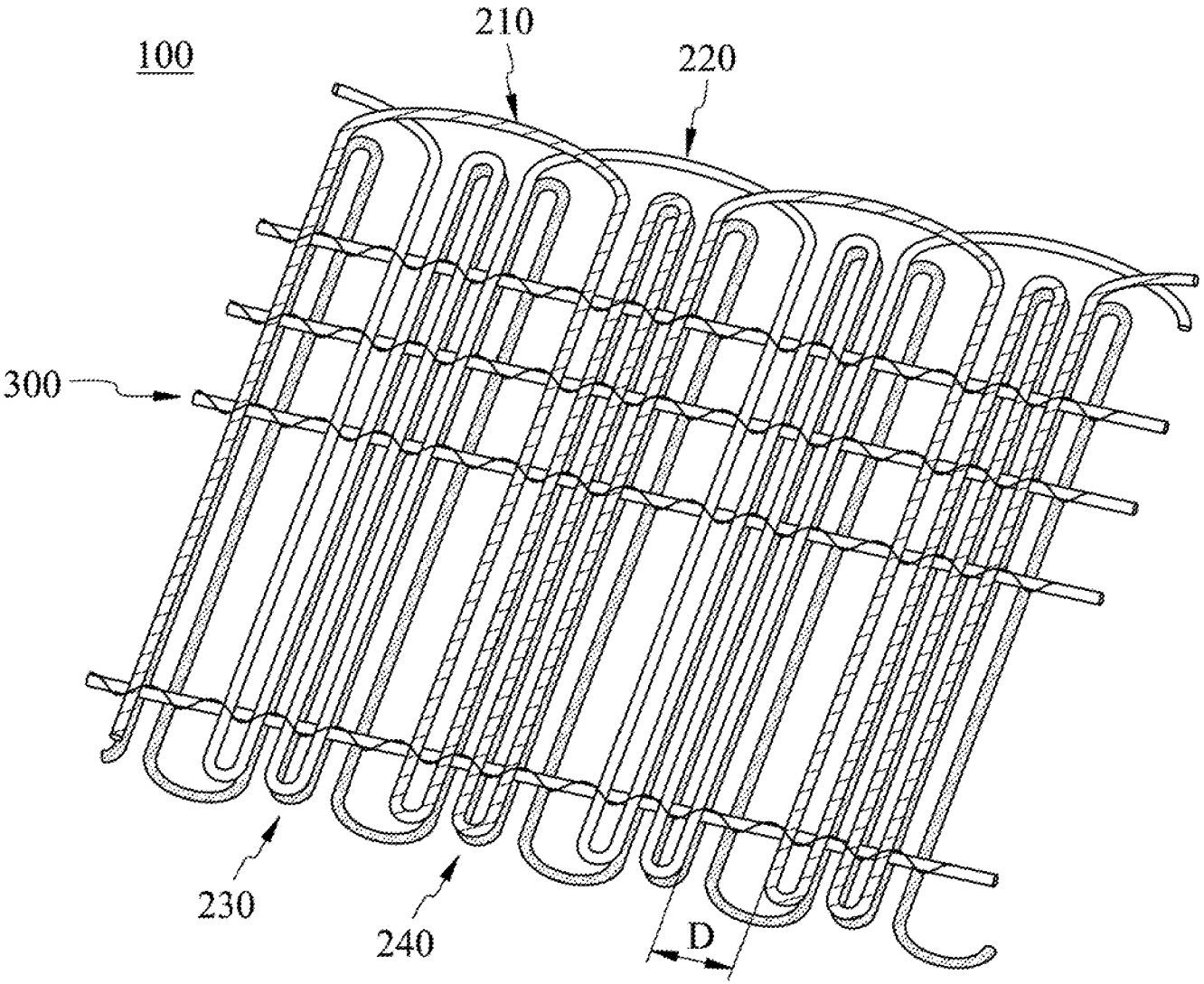
FIG. 12 shows a three dimensional view of a textile with elasticity according to still another embodiment of the present disclosure.
Figure 13:
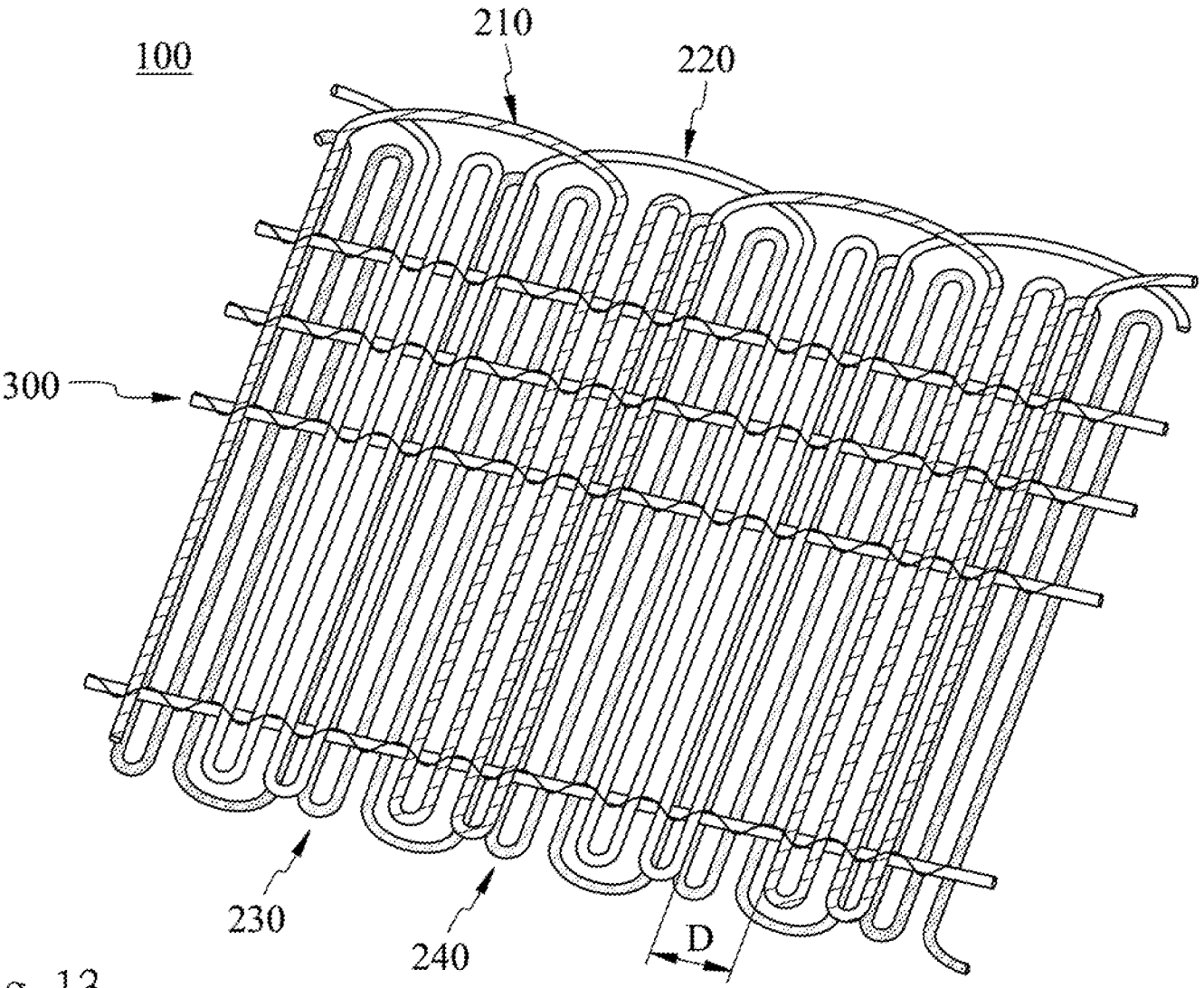
FIG. 13 is a schematic view of a distance being complemented of the textile with elasticity of FIG. 12.

FIG. 12 shows a three dimensional view of a textile with elasticity 100 according to still another embodiment of the present disclosure. FIG. 13 is a schematic view of a distance D being complemented of the textile with elasticity 100 of FIG. 12. Please refer to FIG. 12 and FIG. 13, because the distance D is kept with the twine 320, each of the weft units is independent. Therefore, the third weft unit 230 and the fourth weft unit 240 can move in parallel at the rear side of the textile with elasticity 100.

In the still another embodiment, the distance D is occupied partially by the third weft unit 230 or the fourth weft unit 240, so the width of the distance D can be change by adjusting the position of the mentioned weft units disposed at both side of the textile with elasticity 100. Therefore, the proportion of exposure of the distance D also can be adjusted.

In FIG. 13, the distance D is occupied mostly by the third weft unit 230 or the fourth weft unit 240. In views of the embodiments disclosed in FIG. 12 and FIG. 13, the color or material of the first elastic weft yarns 211, the second elastic weft yarns 221, the third elastic weft yarns 231 and the fourth elastic weft yarns 241 can be different since the mentioned weft units are independent, this feature makes mechanical properties and appearance variable. That is, each of the distances D between any two elastic weft yarns can be different, so the density of weave structure of the textile with elasticity 100 is variable, too.

According to the foregoing embodiments, the advantages of the present disclosure are described as follows. 1. The textile with elasticity provides better ventilation property for textile products by using elastic material and special weave structure, the features solve the problem that textile products can't take care of elasticity and ventilation. 2. The materials of the textile with elasticity are inexpensive, this advantage makes the textile with elasticity reduce the cost. 3. The weave structure of the textile with elasticity is stable for the reason each of the elastic warp yarns is tied by the twine independently. Even if some of the elastic warp yarns are drawn out, the textile with elasticity can still maintain the structural integrity. 4. Because of the distances are kept by the slip knots, each of the distances can be adjusted respectively for different requirements when applying to textile products. Moreover, number of the elastic weft yarns of the weft units can be changed flexibly for adjusting the elasticity of the textile with elasticity.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A textile with elasticity, comprising:

a first weft unit comprising a plurality of first elastic weft yarns adjacent and parallel to each other;

a second weft unit comprising a plurality of second elastic weft yarns adjacent and parallel to each other, wherein the first weft unit and the second weft unit are distributed staggeredly at a front side of the textile with elasticity;

a third weft unit comprising a plurality of third elastic weft yarns adjacent and parallel to each other;

a fourth weft unit comprising a plurality of fourth elastic weft yarns adjacent and parallel to each other, wherein the third weft unit and the fourth weft unit are distributed alternately at a rear side of the textile with elasticity and corresponded to the first weft unit and the second weft unit respectively;

wherein the first elastic weft yarns are woven to and fro in a continuous first S-shaped configuration by a first fabric, and the second elastic weft yarns are woven to and fro in a continuous second S-shaped configuration by a second fabric, four of the first elastic weft yarns are formed into a first sub unit that forms the first S-shaped configuration and four of the second elastic weft yarns are formed into a second sub unit that forms the second S-shaped configuration, and the first sub unit is adjacent to the second sub unit and separated from the second sub unit by a distance, the distance is continuous along an entire length of the first sub unit and the second sub unit;

wherein the third elastic weft yarns and the fourth elastic weft yarns are woven continuously into continuous S-shaped by a single fabric, and adjacent to each other are separated by the distance;

wherein each of the first elastic weft yarns and each of the third elastic weft yarns are parallel to each other and separated by a gap between the front side and the rear side;

wherein each of the second elastic weft yarns and each of the fourth elastic weft yarns are parallel to each other and separated by the gap; and a warp yarn layer comprising a plurality of elastic warp yarns longitudinally disposed within the gap, wherein each of the elastic warp yarns comprises a twine tying one of the elastic warp yarns as a center for binding the first weft unit, the second weft unit, the third weft unit and the fourth weft unit to keep the distance;

wherein the first fabric and the second fabric overlap each other in an area that is in an one end of the distance between the first sub unit and the second sub unit and in a direction of the gap between the front side and the rear side of the textile with elasticity.

2. The textile with elasticity of claim 1, wherein each of the first elastic weft yarns comprises a main yarn and at least one covering yarn, the main yarns are elastic fabrics, and each of the main yarns is helically wrapped by the covering yarn.

3. The textile with elasticity of claim 1, wherein each of the second elastic weft yarns comprises a main yarn and at least one covering yarn, the main yarns are elastic fabrics, and each of the main yarns is helically wrapped by the covering yarn.

4. The textile with elasticity of claim 1, wherein each of the third elastic weft yarns comprises a main yarn and at least one covering yarn, the main yarns are elastic fabrics, and each of the main yarns is helically wrapped by the covering yarn.

5. The textile with elasticity of claim 1, wherein each of the fourth elastic weft yarns comprises a main yarn and at least one covering yarn, the main yarns are elastic fabrics, and each of the main yarns is helically wrapped by the covering yarn.

6. The textile with elasticity of claim 1, wherein the first elastic weft yarns, the second elastic weft yarns, the third elastic weft yarns and the fourth elastic weft yarns are the same material.

7. The textile with elasticity of claim 1, wherein the elastic warp yarns are elastic fabrics.

8. A textile with elasticity, comprising:

a first weft unit comprising a plurality of first elastic weft yarns adjacent and parallel to each other;

a second weft unit comprising a plurality of second elastic weft yarns adjacent and parallel to each other, wherein the first weft unit and the second weft unit are distributed staggeredly at a front side of the textile with elasticity;

wherein the first elastic weft yarns are woven to and fro in a continuous first S-shaped configuration by a first fabric, and the second elastic weft yarns are woven to and fro in a continuous second S-shaped configuration by a second fabric, four of the first elastic weft yarns are formed into a first sub unit that forms the first S-shaped configuration and four of the second elastic weft yarns are formed into a second sub unit that forms the second S-shaped configuration, and the first sub unit is adjacent to the second sub unit and separated from the second sub unit by a distance, the distance is continuous along an entire length of the first sub unit and the second sub unit;

a plurality of elastic warp yarns longitudinally disposed on one side of the first elastic weft yarns and the second elastic weft yarns; and a plurality of twines, wherein each of the twines ties the corresponded elastic warp yarn as a center for binding the first weft unit and the second weft unit to keep the distance;

wherein the first fabric and the second fabric overlap each other in an area that is in an one end of the distance between the first sub unit and the second sub unit.

9. The textile with elasticity of claim 8, wherein each of the first elastic weft yarns comprises a main yarn and at least one covering yarn, the main yarns are elastic fabrics, and each of the main yarns is helically wrapped by the covering yarn.

10. The textile with elasticity of claim 8, wherein each of the second elastic weft yarns comprises a main yarn and at least one covering yarn, the main yarns are elastic fabrics, and each of the main yarns is helically wrapped by the covering yarn.

11. The textile with elasticity of claim 8, wherein the first elastic weft yarns and the second elastic weft yarns are the same material.

12. The textile with elasticity of claim 8, wherein the elastic warp yarns are elastic fabrics.

13. A textile with elasticity, comprising:

a first weft unit comprising a plurality of first elastic weft yarns adjacent and parallel to each other;

a second weft unit comprising a plurality of second elastic weft yarns adjacent and parallel to each other, wherein the first weft unit and the second weft unit are distributed staggeredly at a front side of the textile with elasticity;

a third weft unit comprising a plurality of third elastic weft yarns adjacent and parallel to each other, wherein the third weft unit is disposed at a rear side of the textile with elasticity and corresponded to the first weft unit and the second weft unit;

wherein the first elastic weft yarns are woven to and fro in a continuous first S-shaped configuration by a first fabric, and the second elastic weft yarns are woven to and fro in a continuous second S-shaped configuration by a second fabric, four of the first elastic weft yarns are formed into a first sub unit that forms the first S-shaped configuration and four of the second elastic weft yarns are formed into a second sub unit that forms the second S-shaped configuration, and the first sub unit is adjacent to the second sub unit and separated from the second sub unit by a distance, the distance is continuous along an entire length of the first sub unit and the second sub unit;

wherein the third elastic weft yarns are woven to and fro in a continuous third S-shaped configuration by a third fabric;

wherein each of the third elastic weft yarns is separated in parallel with each of the first elastic weft yarns and each of the second elastic weft yarns by a gap between the front side and the rear side; and a warp yarn layer comprising a plurality of elastic warp yarns longitudinally disposed within the gap, wherein each of the elastic warp yarns comprises a twine tying one of the elastic warp yarns as a center for binding the first weft unit and the second weft unit to keep the distance, the twines tie the third weft unit in the opposite of the first weft unit and the second weft unit;

wherein the first fabric and the second fabric overlap each other in an area that is in an one end of the distance between the first sub unit and the second sub unit and in a direction of the gap between the front side and the rear side of the textile with elasticity.

14. The textile with elasticity of claim 13, wherein one of the twines ties at least one of the third elastic weft yarns within the distance.

15. The textile with elasticity of claim 13, wherein each of the first elastic weft yarns comprises a main yarn and at least one covering yarn, the main yarns are elastic fabrics, and each of the main yarns is helically wrapped by the covering yarn.

16. The textile with elasticity of claim 13, wherein each of the second elastic weft yarns comprises a main yarn and at least one covering yarn, the main yarns are elastic fabrics, and each of the main yarns is helically wrapped by the covering yarn.

17. The textile with elasticity of claim 13, wherein each of the third elastic weft yarns comprises a main yarn and at least one covering yarn, the main yarns are elastic fabrics, and each of the main yarns is helically wrapped by the covering yarn.

18. The textile with elasticity of claim 13, wherein the first elastic weft yarns, the second elastic weft yarns and the third elastic weft yarns are the same material.

19. The textile with elasticity of claim 13, wherein the elastic warp yarns are elastic fabrics.

20. The textile with elasticity of claim 1, wherein:

each of the elastic warp yarns of the warp yarn layer extends along a first direction;

the distance between the first sub unit and the second sub unit is in the first direction, and is between one of the four of the first elastic weft yarns forming the first sub unit and which is closest to the second sub unit and one of the four of the second elastic weft yarns forming the second sub unit and which is closest to the first sub unit; and the distance remains substantially constant between any point of the one of the four of the first elastic weft yarns and a corresponding point of the one of the four of the second elastic weft yarns that is directly opposite to the any point in the first direction.

21. The textile with elasticity of claim 20, wherein:

a passageway is formed between the first sub unit of the first elastic weft yarns and the second sub unit of the second elastic weft yarns, the passageway extending along a second direction which is perpendicular to the first direction; and the passageway is free of any one of the four of the first elastic weft yarns formed into the first sub unit and any one of the four of the second elastic weft yarns formed into the second sub unit.

* * * * *